US009382664B2

(12) United States Patent
White et al.

(10) Patent No.: US 9,382,664 B2
(45) Date of Patent: Jul. 5, 2016

(54) CREPING ADHESIVE COMPOSITIONS AND METHODS OF USING THOSE COMPOSITIONS

(75) Inventors: David W. White, Clintonville, WI (US); Jeffery J. Boettcher, Appleton, WI (US); Eric J. Lepp, Combined Locks, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 13 days.

(21) Appl. No.: 13/343,041

(22) Filed: Jan. 4, 2012

(65) Prior Publication Data

US 2012/0168103 A1 Jul. 5, 2012

Related U.S. Application Data

(60) Provisional application No. 61/460,596, filed on Jan. 5, 2011.

(51) Int. Cl.

| | |
|---|---|
| ***C08L 29/04*** | (2006.01) |
| ***C09J 129/04*** | (2006.01) |
| ***D21F 5/02*** | (2006.01) |
| ***D21H 21/00*** | (2006.01) |
| ***D21H 25/00*** | (2006.01) |
| ***D21H 21/14*** | (2006.01) |

(52) U.S. Cl.
CPC ..... *D21H 21/146* (2013.01); *D21H 25/005* (2013.01)

(58) Field of Classification Search
CPC ..... D21H 25/00; D21H 21/146
USPC ..... 524/503; 525/56, 58
See application file for complete search history.

(56) References Cited

U.S. PATENT DOCUMENTS

| | | | | |
|---|---|---|---|---|
| 1,672,156 | A | | 6/1928 | Herrmann et al. |
| 1,971,951 | A | | 8/1934 | Skirrow et al. |
| 2,109,883 | A | | 3/1938 | Herrmann et al. |
| 2,926,116 | A | * | 2/1960 | Keim ..... 162/164.3 |
| 3,058,873 | A | | 10/1962 | Keim et al. |
| 3,301,746 | A | | 1/1967 | Sanford et al. |
| 3,432,936 | A | | 3/1969 | Cole et al. |
| 3,772,076 | A | | 11/1973 | Keim |
| 4,501,640 | A | | 2/1985 | Soerens |
| 4,508,885 | A | * | 4/1985 | Nishiwaki et al. ..... 526/318 |
| 4,528,316 | A | * | 7/1985 | Sorens ..... 524/503 |
| 4,529,480 | A | | 7/1985 | Trokhan |
| 4,720,383 | A | | 1/1988 | Drach et al. |
| 5,096,954 | A | * | 3/1992 | Yamada et al. ..... 524/385 |
| 5,223,096 | A | | 6/1993 | Phan et al. |
| 5,262,007 | A | | 11/1993 | Phan et al. |
| 5,264,082 | A | | 11/1993 | Phan et al. |
| 5,312,522 | A | | 5/1994 | Phan et al. |
| 5,338,807 | A | | 8/1994 | Espy et al. |
| 5,415,737 | A | | 5/1995 | Phan et al. |
| 5,607,551 | A | | 3/1997 | Farrington et al. |
| 5,656,134 | A | | 8/1997 | Marinack et al. |
| 5,685,954 | A | | 11/1997 | Marinack et al. |
| 5,690,788 | A | | 11/1997 | Marinack et al. |
| 5,730,839 | A | | 3/1998 | Wendt et al. |
| 5,865,955 | A | | 2/1999 | Ilvespää et al. |
| 5,885,415 | A | | 3/1999 | Marinack et al. |
| 5,885,416 | A | | 3/1999 | Marinack et al. |
| 5,885,417 | A | | 3/1999 | Marinack et al. |
| 5,908,533 | A | | 6/1999 | Marinack et al. |
| 5,961,782 | A | | 10/1999 | Luu et al. |
| 5,968,590 | A | | 10/1999 | Ahonen et al. |
| 6,001,421 | A | | 12/1999 | Ahonen et al. |
| 6,096,168 | A | | 8/2000 | Marinack et al. |
| 6,119,362 | A | | 9/2000 | Sundqvist |
| 6,207,011 | B1 | | 3/2001 | Luu et al. |
| 6,208,597 | B1 | | 3/2001 | Yoshimi |
| 6,214,932 | B1 | | 4/2001 | Maslanka |
| 6,245,197 | B1 | | 6/2001 | Oriaran et al. |
| 6,280,571 | B1 | | 8/2001 | Allen |
| 6,425,983 | B1 | | 7/2002 | Marinack et al. |
| 6,432,267 | B1 | | 8/2002 | Watson |
| 6,451,166 | B1 | | 9/2002 | Marinack et al. |
| 6,540,879 | B2 | | 4/2003 | Marinack et al. |

(Continued)

FOREIGN PATENT DOCUMENTS

| | | | | | |
|---|---|---|---|---|---|
| CN | 1723318 | A | | 1/2006 | |
| CN | 101535037 | A | | 9/2009 | |
| JP | 2008223161 | A | | 9/2008 | |
| JP | 2010-168701 | | * | 8/2010 | ..... D21H 27/00 |
| JP | 2010-168701 | A | | 8/2010 | |
| WO | WO 99/58622 | | * | 11/1999 | |
| WO | WO2004033793 | A2 | | 4/2004 | |
| WO | WO2006113025 | A2 | | 10/2006 | |

OTHER PUBLICATIONS

International Search Report and Written Opinion of the International Searching Authority for PCT/US2012/020255 dated Aug. 24, 2012.
W. P. Evans, Cationic Fabric Softeners, Chemistry and Industry, Jul. 5, 1969, pp. 893-903.
R. R. Egan, Cationic Surface Active Agents as Fabric Softeners, J. Am. Oil Chemist's Soc., 1978, pp. 118-121, vol. 55.
B. C. Trivedi et al., Quaternization of Imidazoline: Unequivocal Structure Proof, J. Am. Oil Chemists' Soc., Jun. 1981, pp. 754-756.
C. A. Finch (ed.), Polyvinyl Alcohol Developments, 1992, pp. 84-93, Wiley, New York.

(Continued)

*Primary Examiner* — Fred M Teskin
*Assistant Examiner* — Marie Reddick
(74) *Attorney, Agent, or Firm* — Laura L. Bozek

(57) ABSTRACT

Improvements to absorbent sheet manufacture include spraying a softener onto the web and providing a creping adhesive to a surface of a heated drying cylinder of a Yankee dryer such that a creping adhesive coating is formed, the creping adhesive comprising a poly(aminoamide)epihalohydrin (PAE) resin and a polyvinyl alcohol copolymer, wherein the polyvinyl alcohol copolymer includes functional repeat units selected from carboxylate repeat units, sulfonate repeat units as well as combinations of the comonomers. A preferred PAE resin is fully crosslinked PAE resin.

13 Claims, 5 Drawing Sheets

(56) References Cited

U.S. PATENT DOCUMENTS

| | | | | |
|---|---|---|---|---|
| 6,663,942 | B1 | 12/2003 | Luu et al. | |
| 6,689,250 | B1 | 2/2004 | Luu et al. | |
| 6,699,359 | B1 | 3/2004 | Luu et al. | |
| 6,709,548 | B2 | 3/2004 | Marinack et al. | |
| 6,808,597 | B2 | 10/2004 | Allen | |
| 6,812,281 | B2 | 11/2004 | Luu et al. | |
| 6,815,497 | B1 | 11/2004 | Luu et al. | |
| 7,351,307 | B2 | 4/2008 | Scherb et al. | |
| 7,381,297 | B2 | 6/2008 | Hernandez-Munoa et al. | |
| 7,399,378 | B2 | 7/2008 | Edwards et al. | |
| 7,404,875 | B2 | 7/2008 | Clungeon et al. | |
| 7,494,563 | B2 | 2/2009 | Edwards et al. | |
| 7,588,661 | B2 | 9/2009 | Edwards et al. | |
| 7,608,164 | B2 | 10/2009 | Chou et al. | |
| 7,638,462 | B2 | 12/2009 | Kawamura et al. | |
| 7,704,349 | B2 | 4/2010 | Edwards et al. | |
| 7,718,035 | B2 | 5/2010 | Boettcher et al. | |
| 7,789,995 | B2 | 9/2010 | Super et al. | |
| 7,820,008 | B2 | 10/2010 | Edwards et al. | |
| 7,935,220 | B2 | 5/2011 | Edwards et al. | |
| 2002/0037946 | A1 | 3/2002 | Isozaki et al. | |
| 2002/0062936 | A1 | 5/2002 | Klerelid et al. | |
| 2002/0122939 | A1 | 9/2002 | Wei et al. | |
| 2005/0065272 | A1* | 3/2005 | Vicari | 524/557 |
| 2006/0207736 | A1 | 9/2006 | Boettcher et al. | |
| 2006/0289134 | A1* | 12/2006 | Yeh et al. | 162/111 |
| 2007/0000630 | A1 | 1/2007 | Hassler et al. | |
| 2007/0208115 | A1 | 9/2007 | Grigoriev et al. | |
| 2008/0105394 | A1 | 5/2008 | Kokko | |
| 2008/0216977 | A1 | 9/2008 | Dyer et al. | |
| 2008/0257507 | A1 | 10/2008 | Campbell | |
| 2009/0120598 | A1 | 5/2009 | Edwards et al. | |
| 2010/0065234 | A1 | 3/2010 | Klerelid et al. | |
| 2010/0139881 | A1 | 6/2010 | Beuther et al. | |
| 2010/0184902 | A1 | 7/2010 | Boettcher et al. | |
| 2010/0186913 | A1 | 7/2010 | Super et al. | |
| 2010/0282423 | A1 | 11/2010 | Super et al. | |
| 2011/0011545 | A1 | 1/2011 | Edwards et al. | |
| 2012/0145341 | A1 | 6/2012 | Super et al. | |
| 2012/0180965 | A1 | 7/2012 | Super et al. | |
| 2012/0180966 | A1 | 7/2012 | Super et al. | |
| 2013/0186581 | A1 | 7/2013 | Super et al. | |
| 2013/0292074 | A1 | 11/2013 | Super et al. | |

OTHER PUBLICATIONS

Herbert H. Espy, Chapter 2: Alkaline-Curing Polymeric Amine-Epichlorohydrin Resins, Wet Strength Resins and Their Application, 1994, pp. 13-44, L. Chan, Editor.

Kuraray America, Inc., Kuraray K-Polymer KL-506, 2010, [online], [ retrieved on Apr. 4, 2010], retrieved from http://www.ides.com/grades/ds/E117263.htm.

Kuraray Co., Ltd., Kuraray Poval, [online], [retrieved on Apr. 4, 2010], retrieved from http://www.poval.jp/english/poval/s_grades/sg_k.html.

Air Products, Airflex 426, 2010, [online], [retrieved on Apr. 9, 2010], retrieved from http://www.specialchem4adhesives.com/tds/airflex-426/air-products/59/index.aspx.

Chinese Office Action with Search Report: Application No. 201280003852.5; International filing date: Jan. 5, 2012; Applicant: Georgia-Pacific Consumer Products LP; Date of notification: May 5, 2014; untranslated Chinese Office Action and search report, 5 pages.

Minhua Hu, The Modification of Polyvinyl Alcochol and the Use Thereof in the Specific Coating Papers; pp. 180-187; Issuing Date: Oct. 1, 2006.

* cited by examiner

CREPING ADHESIVE COMPOSITIONS AND METHODS OF USING THOSE COMPOSITIONS

CLAIM FOR PRIORITY

This non-provisional application is based upon U.S. Provisional Patent Application No. 61/460,596, of the same title, filed Jan. 5, 2011. The priority of U.S. Provisional Patent Application No. 61/460,596 is hereby claimed and the disclosure thereof is incorporated into this application by reference.

TECHNICAL FIELD

This invention relates generally to creping adhesives used in papermaking processes for making absorbent sheet, specifically, adhesives incorporating poly(aminoamide)-epichlorohydrin/polyvinyl alcohol copolymer blends. In preferred embodiments, this invention is directed to the manufacture of soft tissue sheet with spray softener applied thereto prior to adhering the sheet to a Yankee dryer drying cylinder.

BACKGROUND OF THE INVENTION

Absorbent papers are generally manufactured by processes which include suspending cellulosic fibers in an aqueous medium, then removing most of the water from the web by gravity or vacuum-assisted drainage, with or without pressing, followed generally by evaporation either on a drying fabric and/or a Yankee dryer. Manufacture also includes creping in many cases, wherein the cellulosic web is adhered to the surface of a cylindrical dryer, e.g., a Yankee dryer and thereafter separated from the Yankee dryer, typically with the aid of a creping blade. The resultant sheet is wound onto a reel. While paper derives structural integrity from the arrangement of the cellulosic fibers in the web, and also from hydrogen bonding that links the cellulosic fibers to one another, many desirable aesthetic and physical properties of absorbent paper products are influenced by creping from a dryer; for example, creping from a Yankee generally enhances at least one of bulk (and corresponding absorbency), stretch, and softness of the resultant paper product, in part, through disruption of hydrogen bonds between fibers. A creping adhesive is used to increase the effectiveness of the creping operation by adhering the web to the Yankee as well as aiding in the transfer of the web to the drying surface. Creping adhesives also increase drying efficiency by promoting contact between the dryer surface and the paper web and thus are used even in cases where the product is peeled (i.e., little reel crepe) rather than creped from the dryer surface.

Historically, common classes of thermosetting adhesive resins that have been used as Yankee dryer adhesives include poly(aminoamide)-epihalohydrin polymer (PAE) resins, such as those polymers sold under the tradenames KYMENE® and CREPETROL® (Ashland, Inc.), ULTRA-CREPE® (Process Application Ltd. "PAL"), BUBOND® (Buckman Laboratories Inc.). Modern manufacturing processes which use Yankee drying such as through-air drying processes, low-compaction pneumatic dewatering processes and newer fabric-creping or vacuum dewatering processes which do not involve wet-pressing a relatively wet web on a felt to a Yankee dryer typically require an adhesive coating which is both relatively durable as well as rewettable. The requirement of promoting transfer to a Yankee of partially dried, moist webs with a patterned fabric in the transfer nip is particularly challenging when a spray softener is applied to the web prior to transfer to the Yankee as is discussed further herein.

Rewettable PAE/polyvinyl alcohol adhesives are disclosed in U.S. Pat. No. 4,501,640 to Soerens et al. This class of adhesives offers superior adhesion as well as rewettability. It has been postulated that this particular admixture as a creping adhesive is particularly effective for at least two reasons. The first reason is that polyvinyl alcohol is a rewettable adhesive. Rewettability is an important characteristic of creping adhesives since only very small amounts of adhesive are added per revolution of the creping cylinder; provided the newly added adhesive wets the existing adhesive layer, all of the adhesive on the cylinder becomes available to adhere to the web. While the polyamide adhesive is relatively durable, if used by itself it will eventually irreversibly harden and therefore lose its effect as an adhesive. However, by diluting this component with polyvinyalcohol, wettability is greatly improved and the effective life of the adhesive layer on the creping cylinder is extended. The second reason proposed for the success of PAE/polyvinyl alcohol creping adhesives is the cationic nature of the polyamide resin makes it a very specific adhesive for cellulose fibers.

U.S. Pat. No. 7,608,164 to Chou et al. refers to polyvinyl alcohol copolymers which may be used in creping compositions with PAE resins; however, no examples are provided. See Column 8, lines 24-49. See also, U.S. Pat. No. 7,404,875 to Clungeon et al. Col. 1, line 66 to Col. 2 line 35. It will be appreciated by one of skill in the art that there are a large number of known copolymers of polyvinyl alcohol. See United States Patent Application Publication 2002/0037946 of Isozaki et al. which discloses a listing of polyvinyl alcohol copolymers, paragraph [0015], page 2 which mentions comonomers such as acrylic acid, salts thereof and acrylate esters such as methyl acrylate, ethyl acrylate, n-propyl acrylate, isopropyl acrylate, n-butyl acrylate, isobutyl acrylate, tert-butyl acrylate, 2-ethylhexyl acrylate, dodecyl acrylate and octadecyl acrylate; methacrylic acid, salts thereof and methacrylate esters such as methyl methacrylate, ethyl methacrylate, n-propyl methacrylate, isopropyl methacrylate, n-butyl methacrylate, isobutyl methacrylate, tert-butyl methacrylate, 2-ethylhexyl methacrylate, dodecyl methacrylate and octadecyl methacrylate; acrylamide and derivatives thereof such as N-methylacrylamide, N-ethylacrylamide, N,N-dimethylacrylamide, diacetone acrylamide, acrylamidopropanesulfonic acid or salts thereof and acrylamidopropyldimethylamine or salts or quaternary ammonium salts thereof; methacrylamide and derivatives thereof such as N-methylmethacrylamide, N-ethylmethacrylamide, methacrylamidopropanesulfonic acid or salts thereof, methacrylamidopropyldimethylamine or salts or quaternary ammonium salts thereof and N-methylolmethacrylamide or derivatives thereof; vinyl ethers such as methyl vinyl ether, ethyl vinyl ether, n-propyl vinyl ether, isopropyl vinyl ether, n-butyl vinyl ether, isobutyl vinyl ether, tert-butyl vinyl ether, dodecyl vinyl ether and stearyl vinyl ether; N-vinylamides such as N-vinylpyrrolidone, N-vinylformamide and N-vinylacetamide; allyl ethers having a polyalkylene oxide side chain; nitrites such as acrylonitrile and methacrylonitrile; vinyl halides such as vinyl chloride, vinylidene chloride, vinyl fluoride and vinylidene fluoride; allyl compounds such as allyl acetate and allyl chloride; maleic acid or salts or esters thereof; vinylsilyl compounds such as vinyltrimethoxysilane; propenyl acetate and the like.

Creping adhesives, while much improved over the years, need further development as requirements for more adhesive strength and more rewettability are made in connection with new processes and increased machine speeds. Such properties are exceedingly difficult to achieve especially because the adhesive must remain soft and release the web at the dry end of the Yankee.

Wet tack is a measure of the ability of the adhesive coating on the drying cylinder to adhere a wet cellulosic web to the cylinder. The level of adhesion of the cellulosic web to the drying cylinder is generally important as it relates to transfer of the web from a creping fabric to the drying cylinder, as well as control of the web between the dryer and the reel upon which the web is wound. If the web is not sufficiently adhered to the drying cylinder, it may blister or become disengaged from the drying cylinder. Poorly adhered webs are difficult to control and can cause wrinkles during the winding of the web to the parent roll. Further, poorly adhered webs can reduce the potential stretch, bulk and softness properties of the web provided by creping.

Using spray softeners in a tissue making process is highly desirable since the softener can be applied directly to the surface of the sheet where softness is desired instead of being added to the furnish in the wet-end of the papermachine where the softener is dispersed throughout the entire web. The softener is thus more effectively used to achieve the desired effect and less likely to raise manufacturing issues associated with insufficient tensile, since most softeners act as debonders as well. Spray softeners, however, are typically surface active agents and further exacerbate adhesion problems. It has been found that the creping adhesives of the present invention are surprisingly tolerant of spray softeners in papermaking processes.

The level of adhesion of the cellulosic web to the dryer is also important as it relates to drying efficiency. Higher levels of adhesion generally reduce the impedance to heat transfer causing the web to dry faster, thereby enabling more energy efficient, higher speed operation.

Conventional creping adhesives, including PAE/polyvinyl alcohol compositions tend to develop a hard coating which is less rewettable after undergoing the extensive drying required for low moisture creping and removal from the dryer. This hard coating results in a loss of adhesion and also results in blade vibration (chatter), which can cause non-uniform creping, blade wear, and, in extreme cases, damage to the Yankee dryer cylinder surface. Thus, there is a great demand for a creping adhesive that remains soft and rewettable under drying conditions encountered in low moisture creping.

As the demand for softer tissue products continues, the limitations of the current creping adhesive coating packages have become apparent, especially in connection with processes including transfer to a Yankee from a patterned fabric and processes where sprayed-on softeners are employed. The alternative adhesive products of the invention are more effective than conventional adhesives in achieving excellent transfer at the pressure roll and high Yankee adhesion while maintaining a soft coating at low moistures and tolerance to spray softeners.

SUMMARY OF THE INVENTION

A creping adhesive includes a poly(aminoamide)-epihalohydrin (PAE) resin and a polyvinyl alcohol copolymer, wherein the polyvinyl alcohol copolymer includes functional repeat units selected from carboxylate repeat units, sulfonate repeat units, and combinations thereof. The adhesives of the invention provide surprising adhesive strength and enhance drying efficiency as well as improved crepe quality as is seen in higher POROFIL® values and increased stretch at equivalent overall crepe ratios.

The inventive adhesives are also unexpectedly resistant to spray softeners which conventionally cause operating difficulties because softeners are inherently release agents which tend to destroy adhesion on a Yankee dryer surface. One preferred aspect of the invention is thus a method of making absorbent sheet comprising: (a) dewatering an aqueous papermaking furnish to form a nascent web; (b) partially drying the web to a consistency of at least 35% and optionally less than 70% prior to providing the web to a transfer nip; (c) disposing the web on a patterned transfer fabric; (d) spraying a softener onto the web; (e) providing a creping adhesive to a surface of a heated drying cylinder of a Yankee dryer such that a creping adhesive coating is formed, the creping adhesive comprising a poly(aminoamide)epihalohydrin (PAE) resin and a polyvinyl alcohol copolymer, wherein the polyvinyl alcohol copolymer includes functional repeat units selected from carboxylate repeat units, sulfonate repeat units, and combinations thereof; (f) transferring the partially dried web having a consistency of at least 35% from the transfer fabric to the surface of the heated drying cylinder of the Yankee dryer in the transfer nip such that the partially dried web is adhered to the drying cylinder by the creping adhesive coating; (g) drying the partially dried web to a predetermined dryness on the surface of the drying cylinder; and (h) removing the dried web from the drying cylinder surface.

In preferred embodiments the PAE resin may be a fully crosslinked PAE resin.

Further details and advantages will become apparent from the discussion which follows.

BRIEF DESCRIPTION OF THE DRAWINGS

The invention is described in detail below with reference to the attached Figures in which.

DETAILED DESCRIPTION

Figure 1:
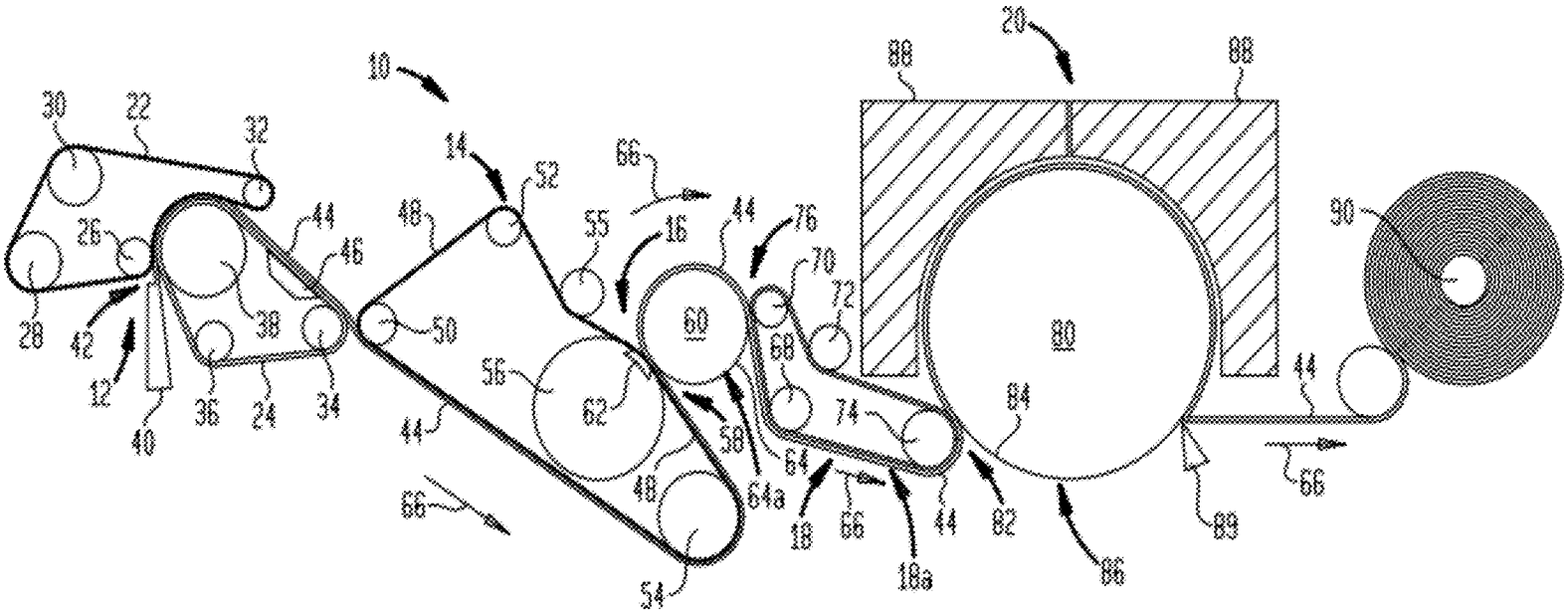
FIG. 1 is a schematic illustration of a papermachine wherein a tissue web is found, adhered to the drying surface of a Yankee dryer, dried, creped, and then wound onto a reel.

The invention is described below with reference to numerous embodiments. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; % means weight percent or mol % as indicated. In the absence of an indication, % refers to weight percent, except that degree of hydrolysis refers to the mol % of polyvinyl acetate units which have been hydrolyzed to hydroxyl repeat units.

With respect to aqueous compositions such as softeners and creping adhesives "add-on", weight ratios and the like refer to the components on a dry basis. For example, softener or creping adhesive usage per tonne (ton) of fiber refers to the weight of active ingredients and bone-dry fiber only. Aqueous compositions of adhesives and/or softeners may be from 70-95 percent water or more.

Unless otherwise specified, "basis weight", BWT, bwt and so forth refers to the weight of a 279 square meter (3000 square-foot) ream of product. Likewise, "ream" means 279 square meter (3000 square-foot) unless otherwise specified, for example in grams per square meter (gsm). Consistency refers to % solids of a nascent web, for example, calculated on a bone dry basis. "Air dry" means including residual moisture, by convention up to about 10% moisture for pulp and up to about 6% for paper. A nascent web having 50% water and 50% bone dry pulp has a consistency of 50%.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, mechanical pulps such as bleached chemical thermomechanical pulp (BCTMP). "Furnishes" and like terminology refers to aqueous compositions including papermaking fibers, optionally wet strength resins, debonders and the like for making paper products. Recycle fiber is typically more than 50% by weight hardwood fiber and may be 75%-80% or more hardwood fiber.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish from processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30% or so by application of pressure thereto and/or increasing the consistency of the web by about 15% or more by application of pressure thereto; that is, increasing the consistency, for example, from 30% to 45%.

"Creping fabric", "transfer fabric" and like terminology refers interchangeably to a fabric or belt which bears a pattern suitable for practicing a process of the present invention. "Fabric" includes a polymeric belt with a monolithic structure or layer as is described in United States Patent Application Publication 2010/0186913 of Super et al., the disclosure of which is incorporated herein by reference.

"Fabric side" and like terminology refers to the side of the web which is in contact with the creping fabric. "Dryer side" or "Yankee side" is the side of the web in contact with the drying cylinder, typically opposite the fabric side of the web.

The characteristic viscosity of a PVOH resin refers to the viscosity of a 4 weight % aqueous solution of the material at 20° C. The PVOH can have a characteristic viscosity of from 0.002 Pa-s to 0.01 Pa-s (2 cps to 10 cps). The PVOH can have a characteristic viscosity of from 0.05 Pa-s to 0.08 Pa-s (50 cps to 80 cps). The PVOH can have a characteristic viscosity of from 0.02 Pa-s to 0.04 Pa-s (20 cps to 40 cps).

"Fabric-crepe ratio" is an expression of the speed differential between the creping fabric and the forming wire and typically calculated as the ratio of the web speed immediately before fabric-creping and the web speed immediately following fabric-creping, the forming wire and transfer surface being typically, but not necessarily, operated at the same speed:

$$\text{Fabric-crepe ratio} = \text{transfer cylinder speed} \div \text{creping fabric speed}$$

Fabric-crepe can also be expressed as a percentage calculated as:

$$\text{Fabric-crepe,\%,} = [\text{Fabric-crepe ratio} - 1] \times 100\%$$

A web creped from a transfer cylinder with a surface speed of 228.6 mpm (750 fpm) to a fabric with a velocity of 152.4 mpm (500 fpm) has a fabric-crepe ratio of 1.5 and a fabric-crepe of 50%. For reel crepe, the reel crepe ratio is calculated as the Yankee speed divided by reel speed. To express reel crepe as a percentage, 1 is subtracted from the reel crepe ratio and the result multiplied by 100%.

The total crepe ratio is calculated as the ratio of the forming wire speed to the reel speed and a % total crepe is:

$$\text{Total Crepe \%} = [\text{Total Crepe Ratio} - 1] \times 100\%$$

A process with a forming wire speed of 609.6 mpm (2000 fpm) and a reel speed of 304.8 mpm (1000 fpm) has a line or total crepe ratio of 2 and a total crepe of 100%.

A product is considered "peeled" from a Yankee drying cylinder when removed without substantial reel crepe, under tension. Typically, a peeled product has less than 1% reel crepe.

The PAE/polyvinyl alcohol copolymer creping adhesive may be applied as a single composition or may be applied in its component parts. More particularly, the polyamide resin may be applied separately from the polyvinyl alcohol (PVOH) and the modifier and other optional components.

Velocity delta means a difference in linear speed.

The void volume and/or void volume ratio as referred to hereafter, are determined by saturating a sheet with a nonpolar POROFIL® liquid and measuring the amount of liquid absorbed. The volume of liquid absorbed is equivalent to the void volume within the sheet structure. The % weight increase (PWI) is expressed as grams of liquid absorbed per gram of fiber in the sheet structure times 100, as noted hereinafter. More specifically, for each single-ply sheet sample to be tested, select 8 sheets and cut out a 2.54 cm by 2.54 cm square (1 inch by 1 inch) square (2.54 cm in the machine direction and 2.54 cm in the cross-machine direction) (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL® liquid having a specific gravity of about 1.93 grams per cubic centimeter, available from Coulter Electronics Ltd., Northwell Drive, Luton, Beds, England; Part No. 9902458.) After 10 seconds, grasp the specimen at the very edge (1-2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL® liquid per gram of fiber, is calculated as follows:

$$PWI=[(W_2-W_1)/W_1]\times 100$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100.

"Wet-tack" refers generally to the ability of an adhesive coating on a drying cylinder to adhere a wet web to the cylinder for purposes of drying the web.

Polyamide resins for use in connection with the present invention are poly(aminoamide)-epichlorohydrin (PAE) resins which are known in the art. PAE resins are described, for example, in "Wet-Strength Resins and Their Applications," Ch. 2, entitled Alkaline-Curing Polymeric Amine-Epichlorohydrin Resins, H. Espy (L. Chan, Editor, TAPPI Press, 1994), which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms. PAE resins useful in connection with the present invention include highly reactive, partially crosslinked PAE resins, partially crosslinked resins of lower reactivity and in one preferred embodiment, fully crosslinked PAE resins. Fully and partially crosslinked PAE are described in United States Patent Application 2006/0207736, the disclosure of which is incorporated herein by reference. The extent of cross-linking, whether partial or fully cross-linked, can be controlled with reaction conditions. For fully cross-linked polymer, epihalohydrin is added in aliquots to base polymer and reacted at high temperature at each stage until there is viscosity "burn-out", with no more advancement. The polymer is then acidified, ensuring that the difunctional epihalohydrin has reacted completely with prepolymer. The correct viscosity end point is determined by carefully controlling the amount of epihalohydrin added. For partial cross-linking, a small excess of epihalohydrin is added (compared to fully cross-linked, either in aliquots or at once) and reacted to a pre-determined viscosity end point before the reaction burns out. The viscosity advancement is halted at the determined end point by addition of acid. This ensures that the epihalohydrin is not completely cross-linked and that some residual pendant chlorohydrin remains.

One can distinguish differences in the degree of cross-linking with total and ionic chloride titrations. C-13 NMR can detect pendant chlorohydrin present in partially cross-linked resins. Also, the viscosity of the partially cross-linked material can be made to advance with heat, and can change during storage while fully cross-linked materials are far more stable over time.

In some embodiments, thermosetting PAE resins may be used, while in other embodiments, non-thermosetting PAE resins are employed.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters. These resins generally are characterized by a mole ratio of polyamide/epihalohydrin of 1:0.33 to 1:0.1 in many cases.

Thermosetting polyamide resins for use in connection with the present invention may be made from the reaction product of an epihalohydrin resin and a polyamide containing secondary amine or tertiary amines. In the preparation of such a resin, a dibasic carboxylic acid is first reacted with the polyalkylene polyamine, optionally in aqueous solution, under conditions suitable to produce a water-soluble polyamide. The preparation of the resin is completed by reacting the water-soluble amide with an epihalohydrin, particularly epichlorohydrin, to form the water-soluble thermosetting resin.

The preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety. The polyamide secondary amine groups are preferably derived from a polyalkylene polyamine for example polyethylene polyamides, polypropylene polyamines or polybutylene polyamines and the like, with diethylenetriamine (DETA) being preferred in a wide variety of resins.

Exemplary PAE resins for use in connection with the present invention include those obtainable from: (1) Process Applications Ltd., including but not limited to ULTRA-CREPE HT; (2) Nalco Chemical Co., including but not limited to Nalco 64551; and (3) Ashland, Inc., including but not limited to CREPETROL 1145 and CREPETROL 3557.

One preferred PAE resin, Nalco 64551®, a fully-crosslinked resin, has molecular weight characteristics (measured by GPC using 2-vinyl pyridine standards) as noted in Table A:

TABLE A

MOLECULAR WEIGHT DISTRIBUTION CALCULATED USING POLY(2-VINYL PYRIDINE)

| PAE Resin | Number Average (Mn) | Peak Mol. Wt. (Mp) | Weight Average (Mw) | Z-Average (Mz) | Poly-dispersity (Mw/Mn) |
|---|---|---|---|---|---|
| Nalco 64551 | 3240 | 4400 | 27,100 | 137,000 | 8.36 |

As used herein, "polyvinyl alcohol resin," "PVOH resin," "PVOH polymer" and like terminology means polyvinyl alcohol resins which are typically prepared from polyvinyl acetate homopolymers or copolymers by saponification thereof which is well known in the art. PVOH resins are derived from homopolymers of vinyl acetate as well as copolymers of vinyl acetate.

Polyvinyl alcohol resins generally may be based on vinyl acetate homopolymer or copolymers of vinyl acetate with any suitable comonomer and/or blends thereof. PVOH resins employed in the present invention are predominately (more than 50 mol % ) based on vinyl acetate monomer which is polymerized and subsequently hydrolyzed to polyvinyl alcohol. Desirably, the resins are more than 75 mol % vinyl acetate derived. Comonomers may be present from about 0.1 to about 50 mol % with vinyl acetate. See Finch et al., Ed. "Polyvinyl Alcohol Developments" (Wiley 1992), pp. 84 and following. The comonomers may be grafted or co-polymerized with vinyl acetate as part of the backbone. Likewise, homopolymers may be blended with copolymers, if so desired. In general, polyvinyl acetate in an alcohol solution can be converted to polyvinyl alcohol, i.e. —$OCOCH_3$ groups are replaced by —OH groups through "hydrolysis," also referred to as "alcoholysis." The degree of hydrolysis refers to the mol % of the resin's vinyl acetate monomer content that has been hydrolyzed. The polyvinyl alcohol copolymer can have a degree of hydrolysis of from 70% to 85% .

Methods of producing polyvinyl acetate-polyvinyl alcohol polymers and copolymers are known to those skilled in the art, U.S. Pat. Nos. 1,672,156; 1,971,951; and 2,109,883, as well as various literature references, describe these types of polymers and their preparation. These polymers may be functionalized as is known in the art by appropriate incorporation of suitable comonomers, Among the literature references are "Vinyl Polymerization," Vol, 1, Part 1, by Ham, published by Marcel Dekker, Inc., (1967) and "Preparative Methods of Polymer Chemistry," by Sorenson and Campbell, published by interscience Publishers, Inc,, New York (1961). The sulfonic acid fimctionalized units preferably include 2-methylacrylamido-2-methyl propane sulfonic acid (AMPS) and/or it sodium salt (NaAMPS) monomers. For carboxylic acid functionalized units, mention may be made of copolymer repeat units derived from acrylic acid, methacrylic acid, fumaric acid, maleic acid, itaconic acid, maleic anhydride, itaconic anhydride, and the like, including salts thereof.

"carboxylate repeat units", "sulfonate repeat units" and like terminiology refers to carboxylic acid moieties and sulfonic acid moieties, respectively and includes salts of these moieties, typically sodium salts and the like. The carboxylated polyvinyl alcohol copolymer can have a carboxylate content of from 1 to 10 mole percent. The carboxylated polyvinyl alcohol copolymer can have a carboxylate content of from 2 to 10 mole percent. The sulfonated polyvinyl alcohol copolymer can have a sulfonate content of from 1 to 20 mole percent. The sulfonated polyvinyl alcohol copolymer can have a sulfonate content of from 2to 10 mole percent.

The creping adhesive can include a weight ratio of polyvinyl alcohol copolymer to PAE resin of from 0.5:1 to 8:1. The creping adhesive can include a weight ratio of polyvinyl alcohol copolymer to PAE resin of from 1:1 to 7:1. The creping adhesive can include a weight ratio of polyvinyl alcohol copolymer to PAE resin of from 0.5:1 to 3:1. The creping adhesive can include a weight ratio of polyvinyl alcohol copolymer to PAE resin of from 3:1 to 7:1. The creping adhesive can include a weight ratio of polyvinyl alcohol copolymer to PAE resin of from 4:1 to 6:1.

The present invention may be practiced in connection with any suitable apparatus using a drying cylinder to which the web is transferred and adhered thereto with a creping adhesive. One suitable apparatus is seen in U.S. Pat. No. 7,704,349 to Edwards et al., the disclosure of which is incorporated herein by reference. If a twin wire former is used as is shown in the appended FIG. 1, the nascent web is conditioned with vacuum boxes and a steam shroud until it reaches a solids content suitable for transferring to a dewatering felt. The nascent web may be transferred with vacuum assistance to the felt. In a crescent former, these steps are unnecessary as the nascent web is formed between the forming fabric and the felt. After further fabric creping as described hereinbelow, the web may be pattern pressed to the Yankee dryer at a pressure of about 35 kN/m to about 70 kN/m (200 to about 400 pounds per linear inch (PLI)).

Various additives appropriate for use in creping adhesive compositions are generally well known to those of ordinary skill in the art. Exemplary additives which may be used include modifiers, release agents, tackifiers, surfactants, dispersants, salts, acids, bases, oils, mineral oils, spreading agents, waxes, and anti-corrosives.

Modifiers generally prevent the adhesive film from hardening. Creping modifiers which may be used optionally include quaternary ammonium complexes, polyethylene glycols and so forth. Non-limiting examples of modifiers include, but are not limited to, a glycol (for example, ethylene glycol or propylene glycol) and a polyol (for example, polyethylene glycol, simple sugars, or oligosaccharides). Modifiers commercially available include those obtainable from Evonik Industries AG or Process Applications, Ltd., based in Washington Crossing, Pa. Creping modifiers from Evonik Industries AG include, but are not limited to, VARISOFT® 222LM, VARISOFT® 222, VARISOFT® 110, VARISOFT® 222LT, VARISOFT® 110 DEG, and VARISOFT® 238. One suitable modifier is FDA PLUS GB available from Process Applications, Ltd.

Phosphate salts may be added to the composition to reduce the hard film build-up on the creping surface of the Yankee dryer. The addition of phosphate salts also has the effect of promoting the anti-corrosion property of the adhesive composition and may be effective as a wetting agent. If a phosphate salt additive is used, the amount will normally be in the range of about 5 to about 15 weight percent, based on the total weight of solids in the adhesive composition. A phosphate salt effective as a spreading agent is monoammonium phosphate:

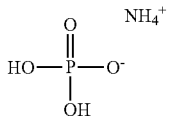

monoammonium phosphate

Softeners which may be sprayed upon the web after its formation are known. Such materials include amido amine salts derived from partially neutralized amines. Softeners are disclosed in U.S. Pat. No. 4,720,383 as well as in Evans, Chemistry and Industry, 5 Jul. 1969, pp. 893-903; Egan, J. Am. Oil Chemist's Soc., Vol. 55 (1978), pp. 118-121; and Trivedi et al., J. Am. Oil Chemist's Soc., June 1981, pp. 754-756, incorporated by reference in their entireties. Softeners are often available commercially only as complex mixtures rather than as single compounds. While the following discussion will focus on the predominant species, it should be understood that commercially available mixtures would generally be used in practice.

Hercules TQ 218 or equivalent is a suitable softener material, which may be derived by alkylating a condensation product of oleic acid and diethylenetriamine.

Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably from about 6 to about 7 and most preferably from about 6.5 to about 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entireties. The compounds are biodegradable diesters of quaternary ammonia compounds, quaternized amine-esters, and biodegradable vegetable oil based esters functional with quaternary ammonium chloride and diester dierucyldimethyl ammonium chloride are representative biodegradable softeners.

In some embodiments, a softener composition includes a quaternary amine component as well as a nonionic surfactant.

Ion-paired softeners may also be utilized. See U.S. Pat. No. 6,245,197 to Oriaran et al., the disclosure of which is incorporated herein by reference. One preferred ion-paired softener has 2% of an anionic silicone, Lambent Syngard™ CPI and 98% imidazolinium/PEG ester mixture. Analysis results appear in Table B.

TABLE B

Compositional results of GP B 100 by C-13 quantitative NMR[1]

| Sample ID | Im+ (Wt. %) | Im (Wt. %) | Other Amide (Wt. %) | PEG di-ester (Wt. %) | PEG ether (Wt. %) | PEG (Wt. %) | PG (Wt. %) | Excess Methyl sulfate (Wt. %) |
|---|---|---|---|---|---|---|---|---|
| GP B-100 | 53.6 | 9.1 | 4.4 | 11.6 | 6.2 | 3.0 | 9.3 | 2.7 |

[1]Im+ is methyl dioleylimidazolinium methyl sulfate. Im is dioleylimidazoline. Other amide is calculated as linear dioleyldiethylenetriamine. PEG is poly ethylene glycol. PEG di-ester is calculated as PEG-400 dioleate. PEG ether is calculated as PEG-400 tridecanol. PG is propylene glycol.

After the web is transferred to the Yankee dryer, it is dried to a solids content of about 95% or so; for example, sometimes up to 98% or more, using pressurized steam to heat the Yankee cylinder and high velocity air hoods. The web is creped using a doctor blade and wound on a reel. The line load at the creping doctor and cleaning doctor may be, for example, about 8.76 kN/m (50 pounds per linear inch (PLI)).

FIG. 1 is a schematic diagram of a papermachine 10 having a conventional twin wire forming section 12, a felt run 14, a shoe press section 16, a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish to a nip 42 between forming roll 38 and roll 26 and the fabrics. The furnish forms a nascent web 44 which is dewatered on the fabrics with the assistance of vacuum, for example, by way of vacuum box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll 56 it may have a consistency of 10-25 percent, preferably 20 to 25 percent or so as it enters nip 58 between shoe press roll 56 and transfer roll 60. Transfer roll 60 may be a heated roll if so desired. Instead of a shoe press roll, roll 56 could be a conventional suction pressure roll. If a shoe press is employed it is desirable and preferred that roll 54 is a vacuum roll effective to remove water form the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at nip 58, typically by increasing the consistency by 15 or more points at this stage of the process. The configuration shown at nip 58 is generally termed a shoe press; in connection with the present invention, transfer roll 60 is operative as a transfer cylinder which operates to convey web 44 at high speed, typically 304.8 mpm-1828.8 mpm (1000 fpm-6000 fpm) to the creping fabric 18.

Transfer roll 60 has a smooth transfer surface 64 which may be provided with adhesive and/or release agents if needed. Web 44 is adhered to transfer surface 64 of transfer roll 60 which is rotating at a high angular velocity as the web continues to advance in the machine-direction 66 indicated by arrows. On the cylinder, web 44 has a generally random apparent distribution of fiber.

Direction 66 is referred to as the machine-direction (MD) of the web as well as that of papermachine 10; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 (sometimes referred to herein as a transfer fabric) as shown in the diagram.

Fabric 18 is supported on a plurality of rolls 68, 70, 72 and a press nip roll 74 and forms a fabric crepe nip 76 with transfer roll 60 as shown.

The creping fabric defines a creping nip over the distance in which creping fabric 18 is adapted to transfer roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction. By using different equipment at the creping nip, it is possible to adjust the fabric creping angle or the takeaway angle from the creping nip. Thus, it is possible to influence the nature and amount of redistribution of fiber, delamination/debonding which may occur at fabric creping nip 76 by adjusting these nip parameters. In some embodiments it may by desirable to restructure the z-direction inter-fiber characteristics while in other cases it may be desired to influence properties only in the plane of the web. The creping nip parameters can influence the distribution of fiber in the web in a variety of directions, including inducing changes in the z-direction as well as the MD and CD. In any case, the transfer from the transfer cylinder to the creping fabric is high impact in that the fabric is traveling slower than the web and a significant velocity change occurs. Typically, the web is creped anywhere from 10-60 percent and even higher during transfer from the transfer cylinder to the fabric.

Creping nip 76 generally extends over a fabric creping nip distance of anywhere from about 0.32 cm to about 5.08 cm (⅛" to about 2"), typically 1.27 cm to 5.08 cm (½" to 2"). For a creping fabric with 32 CD strands per 2.54 cm (inch), web 44 thus will encounter anywhere from about 4 to 64 weft filaments in the nip.

The nip pressure in crepe nip 76, that is, the loading between backing roll 70 and transfer roll 60 is suitably 3.50-17.51 kN/m (20-100 pounds per linear inch) preferably 7.00-12.26 kN/m (40-70 pounds per linear inch (PLI)).

Suitable creping or textured fabrics (also sometimes referred to as the transfer fabric in the specification and claims herein) include single layer or multi-layer, or composite preferably open meshed structures. Fabric construction se is of less importance than the topography of the creping surface in the creping nip as discussed in more detail below. Long MD knuckles with slightly lowered CD knuckles are greatly preferred for many products. Fabrics may have at least one of the following characteristics: (1) on the side of the creping fabric that is in contact with the wet web (the "top" side), the number of machine direction (MD) strands per cm (mesh) is from 3 to 18 (strands per inch (mesh) is from 10 to 200) and the number of cross-direction (CD) strands per cm (count) is from 3 to 18 (strands per inch (count) is also from 10 to 200); (2) the strand diameter is typically smaller than 0.13 cm (0.050 inch); (3) on the top side, the distance between the highest point of the MD knuckles and the highest point on the CD knuckles is from about 0.0025 to about 0.05 or 0.08 cm (from about 0.001 to about 0.02 or 0.03 inch); (4) in between these two levels there can be knuckles formed either by MD or CD strands that give the topography a three dimensional hill/valley appearance which is imparted to the sheet; (5) the fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. An especially preferred fabric is a W013 Albany International multi-layer fabric. Such fabrics are formed from monofilament polymeric fibers having diameters typically ranging from about 0.25 mm to about 1 mm. A particularly preferred fabric is shown in FIG. 7 and following of U.S. Pat. No. 7,494,563 of Edwards et al, the disclosure of which is incorporated herein by reference. Alternatively, a polymeric belt is used as described in United States Patent Application Publication 2010/0186913 noted above, particularly as shown generally in FIGS. 4 and 5 of the publication. The polymeric belt has an upper surface which is generally planar and a plurality of tapered perforations. The belt has a thickness of about 0.2 mm to 1.5 mm and each perforation has an upper lip which extends upwardly from surface of the belt around the upper periphery of the tapered perforations. The perforations on the upper surface are separated by a plurality of flat portions or lands therebetween which separate the perforations.

Creping adhesive is optionally applied to surface **64*a*** to adhere the web, by use of a spray boom.

After fabric creping, the web continues to advance along MD 66. A softener is sprayed to the dryer side of the sheet, at **18*a*, for example, preferably prior to transfer of the web to the Yankee drying cylinder 80. Application of the softener may also be with a spray boom of suitable construction as is known in the art. After softener is provided, the web is wet-pressed onto Yankee drying cylinder 80 in transfer nip 82. Transfer at nip 82 occurs at a web consistency of generally from about 25 to about 70 percent. At these consistencies, it is difficult to adhere the web to surface 84 of Yankee drying cylinder 80** firmly enough to remove the web from the fabric thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee is not achieved.

It has been found in accordance with the present invention that the use of particular adhesives cooperate with a moderately moist web (25-70 percent consistency) to adhere it to the Yankee drying cylinder sufficiently to allow for high velocity operation of the system and high jet velocity impingement air drying. In this connection, a poly(vinyl alcohol)/polyamide adhesive composition of the invention is applied at 86 as needed using a spray boom or other suitable apparatus. Typical addition rates of adhesive to the Yankee drying cylinder are from 0.91 kg (2 lbs) of creping adhesive per tonne (ton) of fiber on a dry basis to about 6.81 kg (15 lbs) per tonne (ton) of fiber on a dry basis. Creping adhesive add-on may suitably be from about 1.36-4.54 kg (3-10 lbs) of adhesive per tonne (ton) of fiber with 1.82-3.63 kg (4-8 lbs) per tonne (ton) of fiber being typical in some cases.

Softener is applied to the partially dried web at **18*a* or other location prior to transfer of the web to the Yankee, also by use of a spray boom as noted above; although any suitable means may be used to apply the softener to web 44**. The softener may be applied at add-on rates of from 0.45 to 13.62 kg (1 to 30 lbs) of softener per tonne (ton) of papermaking fiber in the web; more typically at an add-on rate of from 0.91 to 6.81 kg (2 to 15 lbs) of softener per tonne (ton) of papermaking fiber in the web and in many cases from 1.36 to 4.54 kg (3 to 10 lbs) of softener per tonne (ton) of papermaking fiber in the web.

The web is dried on Yankee drying cylinder 80 which is a heated cylinder and by high jet velocity impingement air in Yankee hood 88. As the cylinder rotates, web 44 is creped from the cylinder by creping doctor 89 and wound on a take-up roll 90. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products. Instead of wet pressing and fabric creping the web, an impingement air dryer, or a through-air dryer could be used to partially dry the web prior to transfer to the Yankee. Impingement air dryers are disclosed in the following patents and applications, the disclosure of which is incorporated herein by reference: U.S. Pat. No. 5,865,955 of Ilvespaaet et al.; U.S. Pat. No. 5,968,590 of Ahonen et al.; U.S. Pat. No. 6,001,421 of Ahonen et al.; U.S. Pat. No. 6,119,362 of Sundqvist et al.; and U.S. Pat. No. 6,432,267. Throughdrying units are well known in the art and described in U.S. Pat. No. 3,432,936 to Cole et al., as well as U.S. Pat. No. 3,301,746 to Sanford et al., the disclosures of which are incorporated herein by reference.

It has been found in accordance with the present invention that the use of certain creping adhesive compositions described herein will adhere the partially dried web to the drying cylinder of a Yankee and may provide one or more of increased wet tack, increased rewetting, increased coating durability, and/or increased adhesion, which thereby result in improved drying efficiency, and/or improved high velocity operation of the system, and/or reduced waste of completed web due to damage from insufficient adhesion.

The creping adhesive compositions disclosed herein may be provided to the drying cylinder as a single composition or as one or more of its components. In one embodiment, the creping adhesive composition is applied to the drying cylinder as a single composition. In another embodiment, the components of the creping adhesive composition are applied separately to the drying cylinder, and allowed to combine on the drying cylinder surface. In a further embodiment, the components of the creping adhesive composition are mixed in-line and co-sprayed onto the drying cylinder.

While the invention is described and illustrated in connection with FIG. 1 and dry-creping with a blade, one of skill in the art will appreciate that the web may be removed by peeling, if so desired, as is described in U.S. Pat. No. 7,608,164 to Chou et al. Likewise, while the invention is suitable for processes including compactively dewatering the papermaking furnish to form a nascent web and concurrently applying the web to a rotating backing cylinder followed by fabric-creping the web from the heated backing cylinder surface at a consistency of from about 30% to about 60% utilizing the transfer fabric and then transferring the web to a Yankee, other processes benefit in a like manner by utilizing the creping adhesive of the present invention.

One process where the present invention may be practiced is described in the literature as Voith's ATMOS® process and is described in U.S. Pat. No. 7,351,307 to Scherb et al., the disclosure of which is incorporated herein by reference. This process includes partially drying the web prior to providing the web to the transfer nip by way of disposing the web on the transfer fabric, contacting one side of the web with a dewatering fabric such that the web is disposed between the transfer fabric and the dewatering fabric and drawing air successively through the transfer fabric and dewatering fabric.

Still another process suitable for use in connection with the present invention is Metso's NTT® process as is described in United States Patent Application Publication 2010/0065234, the disclosure of which is incorporated herein by reference. See, also, United States Patent Application Publications 2010/0139881 and 2002/0062936, the disclosures of which are also incorporated herein by reference. The process of the above applications involve partially drying the web by wet pressing the web onto the transfer fabric in a dewatering nip followed by applying the web to a Yankee drying cylinder.

EXAMPLES

In the examples which follow, the various resins in Table C were tested for use in creping adhesive compositions.

TABLE C

| PVOH and PAE Resins Tested | | |
|---|---|---|
| Grade | Source | Description |
| PVOH and PVOH Copolymers | | |
| CELVOL ® 523 | Sekisui | 88% Hydrolyzed, Medium Viscosity PVOH |
| POVAL ® KL-318 | Kuraray | 88% Hydrolyzed, Medium Viscosity Carboxylated PVOH Copolymer |
| POVAL ® KL-506 | Kuraray | 77% Hydrolyzed, Low Viscosity Carboxylated PVOH |
| CELVOL ® 350 | Sekisui | 98% Hydrolyzed, High Viscosity PVOH |
| ELVANOL ® 75-15 | DuPont | Fully Hydrolyzed, Medium/Low Viscosity Methyl Methacrylate PVOH Copolymer |
| ELVANOL ® 85-82 | DuPont | Fully Hydrolyzed, Medium Viscosity Carboxylated PVOH Copolymer |
| POVAL ® PVA 505 | Kuraray | 72-75% Hydrolyzed Low Viscosity PVOH |
| POVAL ® OTP-5 | Kuraray | 85-90% Hydrolyzed, Low Viscosity Carboxylated PVOH Copolymer |
| POVAL ® KL-118 | Kuraray | 95-99% Hydrolyzed, Medium Viscosity Carboxylated PVOH Copolymer |
| ULTILOC ® 2012 | Sekisui | 85-90%, Medium Viscosity Hydrolyzed Sulfonated PVOH Copolymer |
| EXCEVAL ® AQ-4104 | Kuraray | Copolymer of Ethylene-Vinyl Alcohol |
| EXCEVAL ® RS-2117 | Kuraray | Copolymer of Ethylene-Vinyl Alcohol |
| POVAL ® CM-318 | Kuraray | Copolymer of Carboxylic Acid, Cationic Modified |
| POVAL ® R-2105 | Kuraray | Copolymer of Silanol-Vinyl Alcohol |
| POVAL ® R-3109 | Kuraray | Copolymer of Silanol-Vinyl Alcohol |
| PAE Resins | | |
| ULTRACREPE ® HT | Polymer Applications, Ltd. | PAE Based Thermosetting Adhesive |
| Nalco 64551 | Nalco | PAE Based Fully Crosslinked Non-Reactive Resin |

Example Series 1

Example 1 illustrates the wet tack performance of exemplary creping adhesive compositions of the present invention.

Various functionalized and nonfunctionalized polyvinyl alcohols were used as the non-self crosslinking polymer. Sekisui CELVOL® 523 is an 88% hydrolyzed, medium viscosity PVOH. Kuraray POVAL® KL-318 is an 88% hydrolyzed, medium viscosity carboxylic acid-containing PVOH copolymer. Kuraray POVAL® KL-506 is a 77% hydrolyzed, low viscosity carboxylic acid-containing PVOH copolymer. The PAE resin used was Process Application Ltd. ULTRACREPE HT, a PAE-based crosslinkable polymer.

In this Example Series 1, the PVOH and the PAE listed in Table 1 were mixed at the given percentages to produce a 6.5% solids composition in water using a vortex mixer. The mixtures were dispensed into aluminum weighing dishes such that each dish contained the equivalent of 0.5 gm dry solids. The mixtures were placed into a 125° C. forced air oven for three hours to form a film. Flexibility was determined by tactile observation of the ease with which the film could be bent without breaking. To determine wet tack, a one square inch piece of Georgia-Pacific SofPull® Towel was wetted with tap water and the excess water squeezed out. The wetted towel was pressed into the film with a force of about 103.42 kPa (15 psi). If the towel and film stuck together, such that the dish could be lifted from the table, the amount of time (measured in seconds) that it took for the film to fall from the wet towel was recorded. The longer the towel and film stuck together, the higher the score. The results of this Example Series 1 are presented in Table 1.

TABLE 1

| Status | PVOH | PVOH % of Film | PAE % of Film | Film Appearance | Wet Tack Value |
|---|---|---|---|---|---|
| Comparative | CELVOL ® 523 | 12.5 | 87.5 | Brittle | 4 |
| Comparative | CELVOL ® 523 | 50 | 50 | Slightly Brittle | 2 |
| Comparative | CELVOL ® 523 | 87.5 | 12.5 | Flexible | 4 |
| Invention | POVAL ® KL-318 | 50 | 50 | — | 3 |
| Invention | POVAL ® KL-506 | 12.5 | 87.5 | Brittle | 10 |
| Invention | POVAL ® KL-506 | 50 | 50 | Slightly Brittle | 5 |
| Invention | POVAL ® KL-506 | 87.5 | 12.5 | Flexible | 4 |

As can be seen from Table 1, improvements in wet tack were observed with a ratio of 12.5% functionalized PVOH copolymer Kuraray KL-506 and 87.5% PAL ULTRACREPE® HT, relative to the same ratio of the non-functionalized PVOH homopolymer Sekisui CELVOL® 523 and PAL ULTRACREPE® HT, with no change in film appearance. A wet tack improvement, though not as significant, was also seen when comparing compositions made of those same components at the 50%:50% ratio.

Example Series 2

Example Series 2 illustrates dilution characteristics of functionalized versus nonfunctionalized PVOH. Various functionalized and nonfunctionalized polyvinyl alcohols were used. Sekisui CELVOL® 523 is an 88% hydrolyzed, medium viscosity PVOH. Kuraray POVAL® KL-318 is an 88% hydrolyzed, medium viscosity carboxylic acid-containing PVOH copolymer. Kuraray POVAL® KL-506 is a 77% hydrolyzed, low viscosity carboxylic acid-containing PVOH copolymer.

The "makedown" temperature describes the dilution temperature and indicates the ease of rewet of the creping adhesive. An adhesive with improved rewet characteristics will generally maintain a homogeneous dispersion thereby reducing the incidence of clogging of dispensing nozzles and filters. The rewetability of the creping adhesive is demonstrated by the adhesive's ability to dissolve/dilute at given temperatures. To determine rewetability, a drop of tap water was placed on the films. The films were evaluated as to whether they dissolved, swelled, or became "rubbery."

TABLE 2

| PVOH | Swell/Dissolve | Makedown Temp (° C.) | PVOH Polymer |
|---|---|---|---|
| CELVOL ® 523 | Slowly dissolves | 93 | Homopolymer |
| POVAL ® KL-318 | Very slowly swells/dissolves | 80 | Copolymer |
| POVAL ® KL-506 | Readily swells/dissolves | 80 | Copolymer |

As demonstrated in Table 2, the ability of the Kuraray POVAL® KL-506 to readily swell or dissolve at lower temperatures indicates improved rewet ability.

Example Series 3

A series of films were prepared as in Example Series 1, that is, the PVOH and the PAE listed in Table 3 were mixed at the given percentages to produce a 6.5% solids composition in water using a vortex mixer. The mixtures were dispensed into aluminum weighing dishes such that each dish contained the equivalent of 0.5 gm dry solids. The mixtures were placed into a 125° C. forced air oven for three hours to form a film. Specimens were examined for flexibility/brittleness. Results appear in Table 3. PAL Ultracrepe HT is classified as a thermosetting adhesive. The composition presumably would allow the remaining azetidinium content of the PAE to crosslink with the carboxyl groups of the PVOH-copolymer. This was demonstrated at the 65% PVOH and 35% PAE ratio, where the Kuraray blended film was more brittle or durable relative to the Sekisui blended film.

TABLE 3

Improved coating durability for thermosetting PAE as measured by film study

| PVOH | % of film | PAE | % of film | Film Appearance |
|---|---|---|---|---|
| Celvol ® 523 | 12.5 | PAL Ultracrepe HT | 87.5 | Brittle |
| Celvol ® 523 | 35 | PAL Ultracrepe HT | 65 | Brittle |
| Celvol ® 523 | 50 | PAL Ultracrepe HT | 50 | Slightly Brittle |
| Celvol 523 | 65 | PAL Ultracrepe HT | 35 | Slightly Flexible |
| Celvol ® 523 | 87.5 | PAL Ultracrepe HT | 12.5 | Flexible |
| Poval ® KL-506 | 12.5 | PAL Ultracrepe HT | 87.5 | Brittle |
| Poval ® KL-506 | 35 | PAL Ultracrepe HT | 65 | Brittle |
| Poval ® KL-506 | 50 | PAL Ultracrepe HT | 50 | Slightly Brittle |
| Poval ® KL-506 | 65 | PAL Ultracrepe HT | 35 | Slightly Brittle |
| Poval ® KL-506 | 87.5 | PAL Ultracrepe HT | 12.5 | Flexible |

Example Series 4

Example Series 4 illustrates the adhesive capacity of exemplary creping adhesive compositions of the present invention. Samples were tested in accordance with the procedure described in United States Patent Application Publication 2007/0208115, Use of Organophosphorus Compounds as Creping Aids by Grigoriev et al., page 4, paragraph 0045 the disclosure of which is incorporated herein by reference. Specifically, the adhesion provided by the formulations in Table 4 was measured by means of a wet tack peel adhesion test. This test measured the force required to peel a cotton strip from a heated metal plate. The adhesive blends were mixed using a vortex mixer. The adhesive film was applied to the metal panel by means of a #40 coating rod. The adhesive was applied to the panel at approximately 6.5% actives (100% PVOH films were at 5% solids). The metal plate was heated to 100° C. At this point a wet cotton strip was pressed into the film by means of a 1.9 kg cylindrical roller. After the strip was applied, the metal plate was placed in a 105° C. oven for 15 minutes to dry the strip. The metal plate was then clamped in a tensile testing apparatus. One end of the cotton cloth was clamped in the pneumatic grip of the tester and the cloth was peeled from the panel at an angle of 180° and at a constant speed. During the peeling the metal plate was controlled to a temperature of 100° C. The results are presented in Table 4.

TABLE 4

| PVOH | PVOH % of Film | PAE % of Film | Mean Peel Force g/cm (gm/in) |
|---|---|---|---|
| CELVOL ® 523 | 65 | 35 | 238 (604) |
| CELVOL ® 523 | 100 | 0 | 280 (711) |
| KL-506 | 65 | 35 | 304 (771) |
| KL-506 | 100 | 0 | 262 (665) |

As demonstrated in Table 4, the non-functionalized PVOH/PAE combination had the lowest peel strength. The functionalized PVOH Kuraray POVAL® KL-506 by itself does not provide substantially better adhesion relative to the non-functionalized PVOH Sekisui CEVOL® 523. Increased adhesion was seen with the blend of a functionalized PVOH, Kuraray POVAL® KL-506, and a non-reactive PAE, Nalco 64551.

Example Series 5

Example Series 5 also illustrates the adhesive strength of exemplary compositions of the present invention.

Sekisui CELVOL®523 and Kuraray POVAL® KL-506 are as described in Example Series 1. Sekisui CELVOL® 350 is a 98% hydrolyzed, high viscosity PVOH. DuPont ELVANOL® 75-15 is a fully hydrolyzed, medium-low viscosity PVOH/MMA copolymer. DuPont ELVANOL® 85-82 is a fully hydrolyzed, medium viscosity PVOH carboxylated copolymer.

Figure 2:
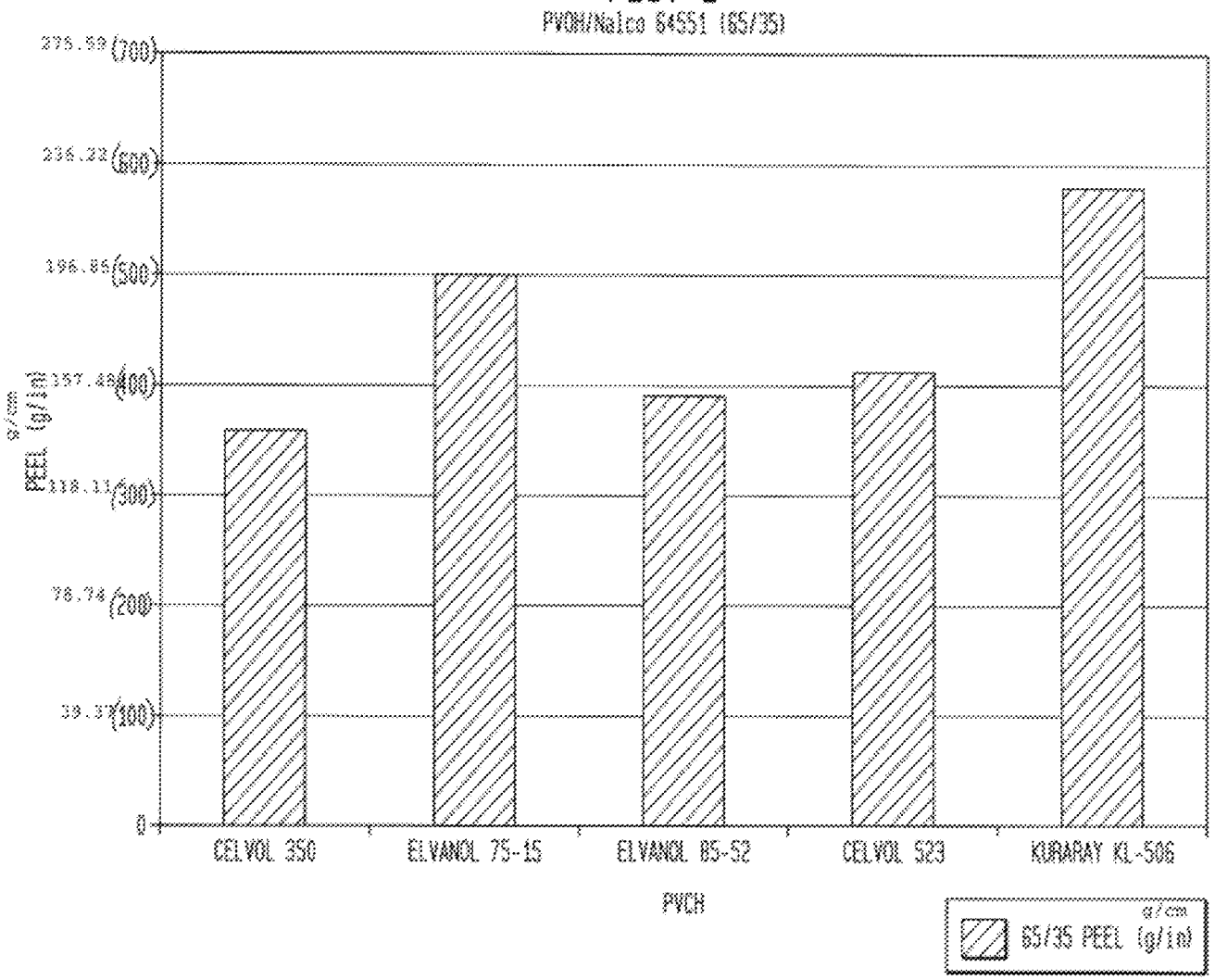
FIG. 2 is a graph showing peel force values in grams per centimeter (grams per inch) of creping adhesive compositions.

The PAE resin was Nalco 64551, a fully crosslinked PAE resin. Samples comprising 65% of the PVOH and 35% of the PAE were prepared as in Example Series 4. The results of the peel force test, conducted as in Example Series 4, are shown in Table 5 and depicted in FIG. 2.

TABLE 5

| PVOH | Mean Peel Force g/cm (gm/in) |
|---|---|
| CELVOL ® 350 | 141 (358) |
| ELVANOL ® 75-15 | 196 (499) |
| ELVANOL ® 85-82 | 154 (390) |
| CELVOL ® 523 | 163 (413) |
| POVAL ® KL-506 | 228 (578) |

The sample comprising carboxylic acid-modified PVOH (KURARAY POVAL KL-506) displayed the highest mean peel force, followed by the sample comprising PVOH/MMA copolymer (ELVANOL 75-15). The sample comprising carboxylic acid-modified PVOH (ELVANOL 85-82) displayed roughly the same mean peel force as the sample comprising 88% hydrolyzed, unfunctionalized PVOH (CELVOL 523). The sample comprising 98% hydrolyzed, unfunctionalized PVOH (CELVOL 350) had the lowest mean peel force.

Example Series 6

Example Series 6 also illustrates the adhesive strength of exemplary compositions of the present invention.

CELVOL®523, POVAL® KL-506, CELVOL® 350, ELVANOL® 75-15, and ELVANOL® 85-82 are as described in Examples Series 1 through 5. Kuraray POVAL® PVA-505 is a 72-75% hydrolyzed, low viscosity PVOH. Kuraray POVAL® OTP-5 is a 85-90% hydrolyzed, low viscosity carboxylic acid-containing PVOH copolymer. Kuraray KL-118 is a medium viscosity, 95-99% hydrolyzed carboxylic acid-containing PVOH copolymer. Kuraray KL-318 is a medium viscosity, 85-90% hydrolyzed carboxylic acid-containing PVOH copolymer. Sekisui ULTILOC® 2012 is a medium viscosity, 95-100% hydrolyzed sulfonated PVOH.

The non-reactive PAE resin employed was Nalco 64551, a fully-crosslinked PAE resin.

Figure 3:
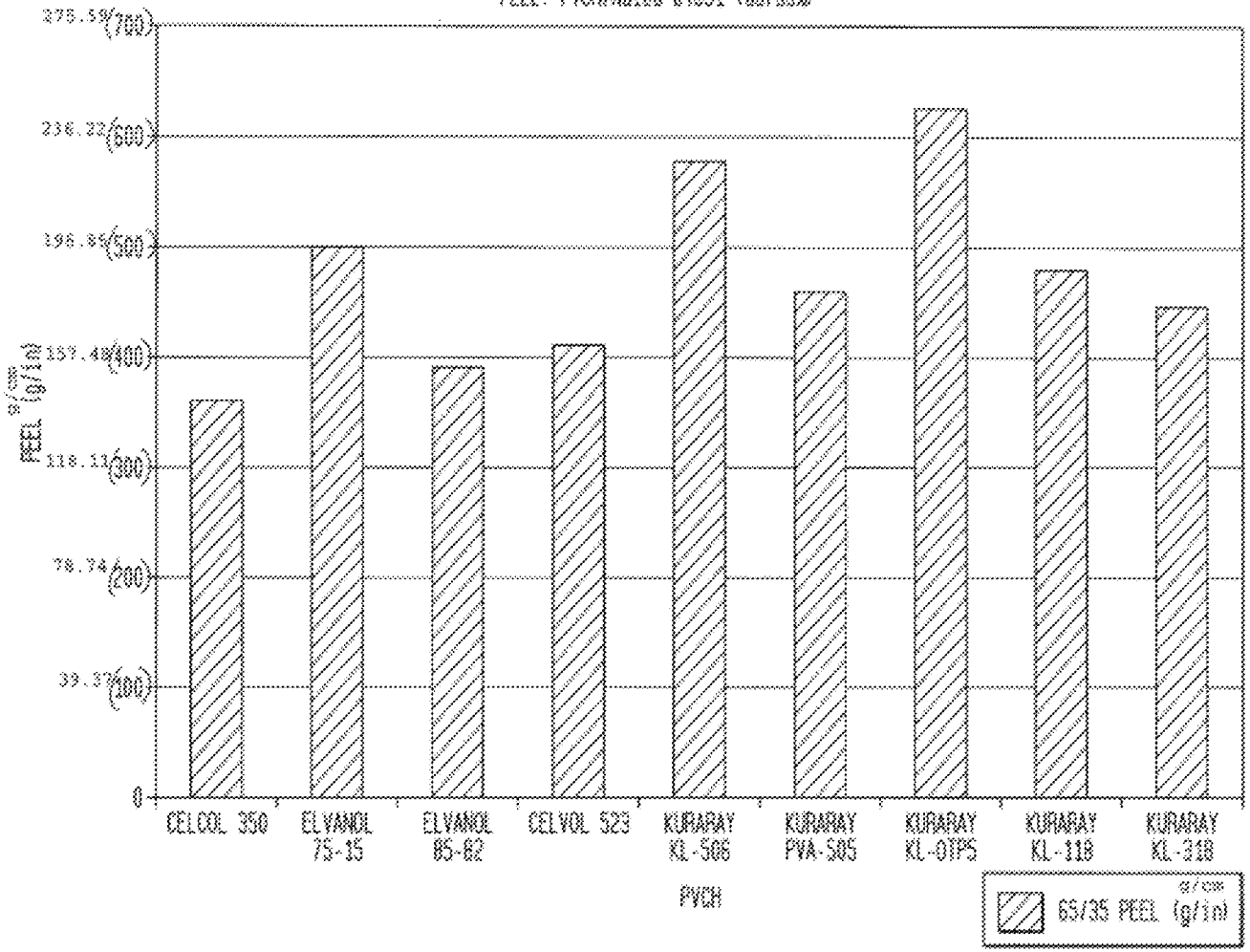
FIG. 3 is a graph showing peel force values in grams per centimeter (grams per inch) of exemplary creping adhesive compositions.

Samples comprising 65% of the PVOH and 35% of the PAE were prepared and tested as in Example Series 4 and 5, as well as samples comprising 100% PVOH and no PAE. That is, the adhesive blends were mixed using a vortex mixer. The adhesive film was applied to the metal panel by means of a #40 coating rod. The adhesive was applied to the panel at approximately 6.5% actives (100% PVOH films were at 5% solids). The metal plate was heated to 100° C. At this point a wet cotton strip was pressed into the film by means of a 1.9 kg cylindrical roller. After the strip was applied, the metal plate was placed in a 105° C. oven for 15 minutes to dry the strip. The metal plate was then clamped in a tensile testing apparatus. One end of the cotton cloth was clamped in the pneumatic grip of the tester and the cloth was peeled from the panel at an angle of 180° and at a constant speed. During the peeling the metal plate was controlled to a temperature of 100° C. The results of the peel force test are shown in Table 6 and depicted in FIG. 3.

TABLE 6

| | | Peel Force g/cm (g/in) | | | | |
|---|---|---|---|---|---|---|
| PVOH | Functionalized | 100% PVOH | 65% PVOH 35% PAE | % Change of Peel Force | Hydrolysis of PVOH | Characteristic Viscosity of PVOH |
| Celvol ® 350 | No | 161.81 (411) | 140.94 (358) | −14.8% | 98-99 | 67 |
| Celvol ® 523 | No | 174.41 (443) | 162.60 (413) | −7.3% | 87-89 | 25 |
| Poval ® PVA 505 | No | 156.3 (397) | 180.71 (459) | 13.5% | 73-75 | 4.6 |
| Poval ® KL-506 | Yes | 164.96 (419) | 227.56 (578) | 27.5% | 74-80 | 5.7 |
| Poval ® OTP-5 | Yes | 218.9 (556) | 246.06 (625) | 11.0% | 85-90 | 6.5 |
| Poval ® KL-118 | Yes | 163.39 (415) | 189.37 (481) | 13.7% | 95-99 | 31.5 |
| Poval ® KL-318 | Yes | 166.14 (422) | 175.98 (447) | 5.6% | 85-90 | 25 |
| UltiLoc ® 2012 | Yes | 200 (508) | 236.61 (601) | 15.5% | 95-100 | 30 |
| Elvanol ® 75-15 | Yes | 190.55 (484) | 196.46 (499) | 3.0% | 99 | 14 |
| Elvanol ® 85-82 | Yes | 190.55 (484) | 153.54 (390) | −24.1% | 99 | 28 |

Moreover, the sample creping adhesive composition according to the present invention comprising 65% of the less highly hydrolyzed non-functionalized PVOH (KL-506) displayed a significant 27.5% improved peel force over the non-inventive sample comprising 100% of the non-functionalized PVOH. Also, in most samples, the sample creping adhesive compositions according to the present invention comprising 65% of a functionalized PVOH displayed greater than a 10% improvement in peel force over the non-inventive samples comprising 100% of the non-functionalized PVOH.

Example Series 7

Following the procedures of Example Series 4, 5 and 6, the PVOH copolymer resins listed in Table 7A were tested for peel strength with and without 35% Nalco 64551 PAE.

TABLE 7A

PVOH Copolymer Resins

| | Copolymer of | Viscosity (mPa x s) | Hydrolysis (mole-%) |
|---|---|---|---|
| AQ-4104 | ethylene-vinyl alcohol | 3.5-4.5 | 98.0-99.0 |
| RS-2117 | ethylene-vinyl alcohol | 23.0-30.0 | 97.5-99.0 |
| CM-318 | carboxylic acid, cationic modified | 17.0-27.0 | 86.0-91.0 |
| R-2105 | silanol-vinyl alcohol | 4.5-6.0 | 98.0-99.0 |
| R-3109 | silanol-vinyl alcohol | 9.0-12.0 | 98.0-99.0 |

Results of peel testing appears in Table 7B.

TABLE 7B

Peel Testing

| Resin | Peel g/cm (lb/2 inch) | Peel g/cm (Ave. g/inch) | 65/35 Blend Peel g/cm (lb/2 inch) | 65/35 Blend Peel g/cm (g/inch) |
|---|---|---|---|---|
| R-2105 | 142 (1.59) | 131 (333) | 22 (0.25) | 22 (57) |
| | 120 (1.34) | | 22 (0.25) | |
| RS-2117 | 172 (1.93) | 173 (439) | 129 (1.45) | 124 (316) |
| | 173 (1.94) | | 119 (1.33) | |
| CM-318 | 161 (1.80) | 160 (406) | 160 (1.79) | 163 (414) |
| | 159 (1.78) | | 166 (1.86) | |
| R-3109 | 147 (1.65) | 151 (384) | 36 (0.40) | 33 (85) |
| | 154 (1.73) | | 31 (0.35) | |
| AQ-4104 | 139 (1.56) | 137 (347) | 138 (1.55) | 136 (345) |
| | 134 (1.50) | | 133 (1.49) | |

Here it is seen that most of the PVOH copolymers did not interact favorably with the PAE resin and none of these PVOH copolymers exhibited substantial synergies as were seen with carboxylated and sulfonated PVOH copolymers and PAE resin blends.

Example Series 8

Utilizing a belt-crepe process as described in connection with FIG. 1 above and in United States Patent Application Publication 2010/0186913 of Super et al., centerline conditions were established where the Yankee coating chemistry was optimized for machine runnability, coating uniformity and build rate, and basesheet handfeel and crepe unformity. Table 8A summarizes the optimum addition rates for coating packages comprising 35% by weight Nalco 64551 PAE and 65% polyvinyl alcohol. Sekisui Celvol® 523 was used as the control and was compared with a creping adhesive using Kuraray Poval® KL-506 copolymer. Relative to the control, the adhesion of Kuraray KL-506 was better at a lower addition rates. This is supported by the increase in Yankee Torque. Observations made during the trial indicated better adhesion as edge flare was eliminated with the KL-506 package, even with 2.72 kg per tonne (6 lbs per ton) of spray softener. Lower addition rates of PVOH is not only a benefit in cost, but would also reduce the likelyhood of coating contamination of the sheet and coating dust generation around the Yankee.

TABLE 8A

Paper Machine Process Data

| | Control 523 | Cell 13 KL-506 |
|---|---|---|
| | Roll # | |
| | 23953 | 23963 |
| Fabric Crepe | 1.20 | 1.20 |
| Reel Crepe | 1.07 | 1.07 |
| Total Crepe | 1.28 | 1.28 |
| Spray Softener kg/tonne (lb/ton) | 2.72 (6.0) | 2.72 (6.0) |
| PVOH kg/tonne (lb/ton) | 1.36 (3.0) | .91 (2.0) |
| Coating kg/tonne (lb/ton) | 1.36 (3.0) | 1.36 (3.0) |
| Modifier kg/tonne (lb/ton) | 0.07 (0.15) | 0.07 (0.15) |
| Yankee Torque (%) | 36 | 38 |

Basesheet Physicals

Shown in Table 8B are the basesheet physicals produced with the centerline targets shown in Table 8A. As shown in Table 8A above, fabric crepe and reel crepe were constant during the trial. High stretch to crepe ratio is often used as a measure of crepe effectiveness. Since total crepe was held constant during this trial, simply comparing MD stretch shows that all trial coatings improved stretch (or crepe) relative to the control.

Void volume weight % increase is also a tool used to measure how well creped or how open the sheet is by measuring the amount of POROFIL® liquid the sheet absorbs. More absorption correlates to more open pores which correlates to better creping. This also supports that the Kuraray KL-506 package creped unexpectedly better than the control.

TABLE 8B

Basesheet Physical Test Data

| | Control 523 | Cell 13 KL-506 |
|---|---|---|
| | Roll # | |
| | 23953 | 23963 |
| Basis Weight $g/m^2$ (lb/3000 $ft^2$) | 22.5 (13.8) | 22.5 (13.8) |
| Caliper mm/8 sheets (mils/8 sheets) | 1.80 (70.8) | 1.80 (70.9) |
| MD Tensile g/cm (g/3") | 63.9 (487) | 64.6 (492) |

TABLE 8B-continued

| Basesheet Physical Test Data | Control 523 | Cell 13 KL-506 |
|---|---|---|
| | Roll # | |
| | 23953 | 23963 |
| MD Stretch (%) | 23.6 | 25.8 |
| CD Tensile | 50.4 | 52.4 |
| g/cm (g/3") | (384) | (399) |
| CD Wet Tensile | 4.2 | 4.7 |
| g/cm (g/3") | (32.2) | (35.5) |
| Actual MD stretch/Theo MD stretch* | 0.83 | 0.91 |
| Void Volume Weight Increase (%) | 850 | 903 |
| Lint Black Felt | 9.1 | 7.9 |

*based on overall crepe

Example Series 9

Using the materials of Examples Series 8 and a F013 Creping (transfer) fabric as described in U.S. Pat. No. 7,494,563 to Edwards et al., additional trials were performed to evaluate resistance of the invention creping adhesives to spray softener applied to the web just prior to the Yankee dryer as shown in FIG. 1.

Increasing levels of Evonik Varisoft GP B 100 spray softener were applied to the web prior to entering the pressure roll transfer nip, as it has been proven to negatively effect how the sheet transfers to the Yankee and disrupts the adhesion causing coarse crepe. This is commonly seen immediately after crepe or cleaning blade changes. Loss of adhesion will be determined by sheet following the fabric out of the pressure roll, edge flare over the Yankee, loose sheet handling through the dry end and crepe structure. The trial matrix starting conditions are listed in Table 9A below. Optimization of the coating was at 2.72 kg per tonne (6 lbs per ton) of spray softener and then remained constant for each adjustment to the spray softener add-on.

TABLE 9A

Trial Cell Matrix

| Cell | PVOH | | GP B 100 kg per tonne (lbs per ton) |
|---|---|---|---|
| 1 Control | Sekisui Celvol ® 523 | 2.72 kg per tonne (6 lbs per ton) | 2.72, 4.09, 5.45, 6.81, 8.17, 9.53 (6, 9, 12, 15, 18, 21) |
| 2 | Kuraray Poval ® KL-506 | 2.72 kg per tonne (6 lbs per ton) | 2.72, 4.09, 5.45, 6.81, 8.17, 9.53 (6, 9, 12, 15, 18, 21) |

The basesheet physical property targets are provided in Table 9B:

TABLE 9B

Basesheet Physical Property Targets

| Attribute | Target |
|---|---|
| Basis Weight | 22.1 |
| $g/m^2$ (lbs/ream) | (13.6) |
| Caliper | 1.78 |
| mm/8 sheets (mils/8 sheets) | (70) |

TABLE 9B-continued

Basesheet Physical Property Targets

| Attribute | Target |
|---|---|
| MD Tensile | 63.6 |
| g/cm (g/3") | (485) |
| CD Tensile | 49.2 |
| g/cm (g/3") | (375) |
| CD Wet Tensile | 5.2 |
| g/cm (g/3") | (40) |

Comments were made in real time during the Example Series 9 as noted below.

Cell 1

The following comments are from Cell 1, 2.27 kg/tonne (5 lb/ton) Celvol® 523 PVOH and 0.45 kg/tonne (1 lb/ton) Nalco 64551 PAE:

Reel 25292—2.72 kg per tonne (6 lb/ton) spray softener
- Sheet looks good. Tight at the edges. Heavy build of coating on front side.
- Change cleaner: Sheet comes off creper nice. Crepe structure looks good.

Reel 25293—4.09 kg/tonne (9 lb/ton) spray softener
- Sheet looks good. Coating building up fast. Transfer is good.
- Change cleaner: Some poor transfer, but it cleaned up immediately. Basesheet looks good.

Reel 25294—5.45 kg/tonne (12 lb/ton) spray softener
- Sheet is coming off the Yankee good. No picking Transfer is good.
- Change cleaner: Transfer remained good. Coating cleaned up well. Basesheet looks good.

Reel 25295—6.81 kg/tonne (15 lb/ton) spray softener
- Sheet looks good. Transfer is good. Tight off the blade.
- Change cleaner: A little loose off the blade but transfer is tight at the edges. Roll build quality is showing sheet weave and not as tight as previous reel. Coarse crepe on front edge, about 1-2 cm in from the edge.

Reel 25296—8.17 kg/tonne (18 lb/ton) spray softener
- Some picking Crepe at edges is still coarse. Roll structure still showing looser sheet handling.
- Change cleaner: No transfer loss. Basesheet looks good, except edges still have coarse crepe.

Reel 25297—9.53 kg/tonne (21 lb/ton) spray softener
- Still running fine. Roll structure and sheet handling still loose off
- Yankee. Crepe inside sheet edges still looks good. Front and back edges have coarse crepe.
- Change cleaner: No issues.

Reel 25298—10.9 kg/tonne (24 lb/ton) spray softener
- Coating build has been streaky all day.
- Change cleaner: Sheet noticeably looser than previous cell.
- Appears coarse crepe is moving further in.

The first sign of coarse crepe was at 6.81 kg/tonne (15 lb/ton) spray softener. The sheet transfer was never an issue through the cell and the sheet edges never flared. The handfeel did not seem to change after 5.45 kg/tonne (12 lb/ton) of spray softener addition.

Cell 2

The following comments are from Cell 2, 2.27 kg/tonne (5 lb/ton) Kuraray POVAL® KL-506 PVOH and 0.45 kg/tonne (1 lb/ton) Nalco 64551 PAE:

Reel 25310—2.72 kg per tonne (6 lb/ton) spray softener
- Sheet looks good.

Reel 25311—4.09 kg/tonne (9 lb/ton) spray softener
Looks good. Coating seems to build faster than previous day. No picking.
Change cleaner: Transfer is good. Edges have been slightly folded over off the blade all morning. Will watch closely today. Crepe looks good. Sheet feels nice.

Reel 25312—5.45 kg/tonne (12 lb/ton) spray softener
Sheet handling is good. Back edge does not appear to have moulding box on it. Some picking and a few spots are repeating.
Change cleaner: Stayed tight on edges. No transfer loss. Roll structure is good Reel 25313—6.81 kg/tonne (15 lb/ton) spray softener
Spray nozzles have plugged. Some picking. Some coarse crepe where spray nozzles are streaming. Will clean nozzles.

Reel 25314—6.81 kg/tonne (15 lb/ton) spray softener
Spray looks good now. Sheet looks good. Roll structure is tight, no weave.
Change cleaner: Stayed tight, good transfer, no coarse crepe.

Reel 25315—8.17 kg/tonne (18 lb/ton) spray softener
No coarse crepe. Sheet transfer is good.
Changed cleaner: Tightened up sheet. Looks good. The back edge is beginning to get loose through the dry end. Basesheet crepe looks good and sheet feels good.

Reel 25316—9.53 kg/tonne (21 lb/ton) spray softener
Yankee back edge has coating coming off more than earlier today. Sheet looks good. Coming off creper tight.
Change cleaner: No transfer loss. Back edge is loose. No coarse crepe.

Reel 25317—10.9 kg/tonne (24 lb/ton) spray softener
Looks good. Back edge is still loose.
Change cleaner: Sheet tightens up. Less floating. Less coating chipping. Basesheet has some coarse crepe on back edge.

The first sign of coarse crepe was at 10.9 kg/tonne (24 lb/ton) spray softener. Sheet transfer remained good all day.

Coating failure with Celvol® 523 occurred at 6.81 kg/tonne (15 lb/ton) of spray softener addition, whereas coating failure with Poval® KL-506 occurred at 10.9 kg/tonne (24 lb/ton) of spray softener addition. Thus, Poval® KL-506 gives better wet adhesion relative to the control as measured by the lack of coarse crepe structures at higher spray softener addition rates.

Runnability, sheet handling, and coarse crepe all show that Kuraray Poval®KL-506 PVOH has higher adhesion than Sekisui Celvol® 523 when used in this coating package.

Figure 4:
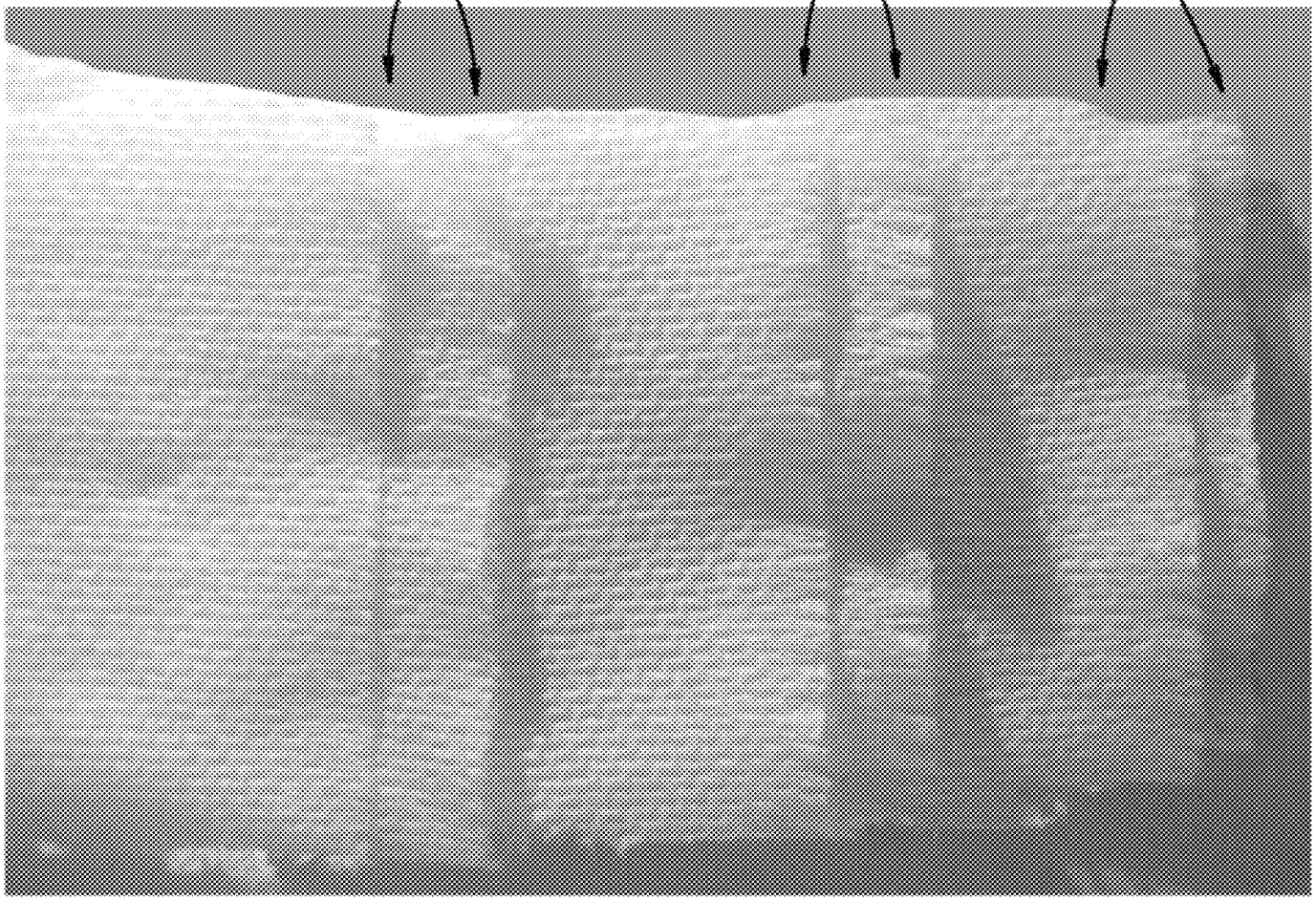
FIGS. 4 and 5 are photographs illustrating coarse crepe resulting from adhesion loss due to increased spray softener levels.
Figure 5:
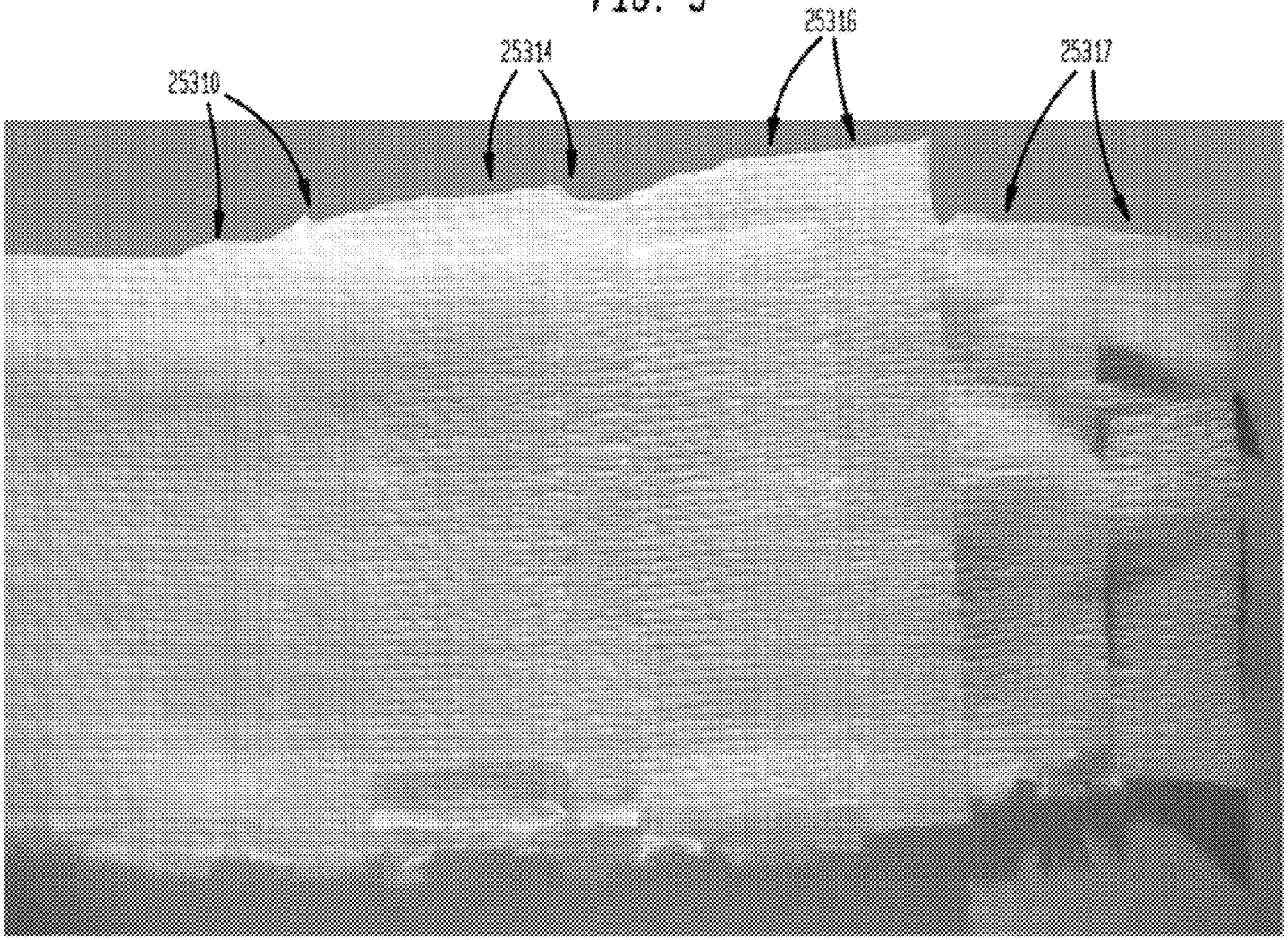

Tolerance to spray softener of the inventive creping adhesive is especially apparent by comparing FIGS. 4 and 5. FIG. 4 shows sheet with the control adhesive and there is no coarse crepe seen at 2.72 kg (6 lbs) softener per tonne (ton) of fiber (Reel 25292). Coarse crepe is an indication of adhesion loss and begins to appear at 6.81 kg (15 lbs) softener per tonne (ton) of fiber (Reel 25295). The sheet at 10.9 kg (24 lbs) softener per tonne (ton) of fiber (Reel 25298) indicates almost complete loss of adhesion at the edge.

On the other hand, FIG. 5 shows no coarse crepe at all at softener add-ons 2.72 kg per tonne (6 lb/ton) (Reel 25310) or at 6.81 kg (15 lbs) per tonne (ton) (Reel 25314) or 9.53 kg (21 lbs) per tonne (ton) (Reel 25316) when the inventive creping adhesive is used. At 10.9 kg (24 lbs) per tonne (ton) some coarse crepe is observed (Reel 25317); however, much less so then seen at 6.81 kg (15 lbs) per tonne (ton) with the control adhesive.

Thus, the inventive compositions exhibit unexpectedly superior adhesion and tolerance to spray softener as compared with conventional PAE adhesives.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

What is claimed is:

1. A creping adhesive comprising a non-thermosetting poly (aminoamide)-epihalohydrin (PAE) resin and a polyvinyl alcohol copolymer, wherein the weight ratio of polyvinyl alcohol copolymer to PAE resin is from 3:1 to 7:1, and the polyvinyl alcohol copolymer comprises vinyl acetate repeat units and functional repeat units selected from carboxylate repeat units, sulfonate repeat units, and combinations thereof and has a degree of hydrolysis of from 70% to 85 mole %.

2. The creping adhesive according to claim 1, wherein the weight ratio of polyvinyl alcohol copolymer to PAE resin is from 4:1 to 6:1.

3. The creping adhesive according to claim 1, wherein the polyvinyl alcohol copolymer is a carboxylated polyvinyl alcohol copolymer.

4. The creping adhesive according to claim 3, wherein the carboxylated polyvinyl alcohol copolymer has a carboxylate content of from 1 to 20 mole percent.

5. The creping adhesive according to claim 3, wherein the carboxylated polyvinyl alcohol copolymer has a carboxylate content of from 2 to 10 mole percent.

6. The creping adhesive according to claim 1, wherein the polyvinyl alcohol copolymer is a sulfonated polyvinyl alcohol copolymer.

7. The creping adhesive according to claim 6, wherein the sulfonated polyvinyl alcohol copolymer has a sulfonate content of from 1 to 20 mole percent.

8. The creping adhesive according to claim 6, wherein the sulfonated polyvinyl alcohol copolymer has a sulfonate content of from 2 to 10 mole percent.

9. The creping adhesive according to claim 1, wherein the polyvinyl alcohol copolymer has a characteristic viscosity of from 0.002 Pa-s to 0.01 Pa-s (2 cps to 10 cps).

10. The creping adhesive according to claim 1, wherein the polyvinyl alcohol copolymer has a characteristic viscosity of from 0.05 Pa-s to 0.08 Pa-s (50 cps to 80 cps).

11. The creping adhesive according to claim 1, wherein the PAE resin is a fully crosslinked PAE resin.

12. The creping adhesive of claim 1, wherein the PAE resin has a mole ratio of polyamide to epihalohydrin of 1:0.33 to 1:0.1.

13. A creping adhesive comprising a non-thermosetting poly(aminoamide)-epihalohydrin (PAE) resin and a polyvinyl alcohol copolymer, wherein the weight ratio of polyvinyl alcohol copolymer to PAE resin is from 3:1 to 7:1, and the polyvinyl alcohol copolymer has a characteristic viscosity of from 0.02 Pa-s to 0.04 Pa-s (20 cps to 40 cps), comprises vinyl acetate repeat units and functional repeat units selected from carboxylate repeat units, sulfonate repeat units, and combinations thereof and has a degree of hydrolysis of from 70% to 85 mole %.

* * * * *